US006837730B2

(12) United States Patent
Poh et al.

(10) Patent No.: US 6,837,730 B2
(45) Date of Patent: Jan. 4, 2005

(54) CONNECTOR WITH FORCE ISOLATING EJECTOR SYSTEM

(75) Inventors: Edmund M. W. Poh, Naperville, IL (US); Scott D. Sommers, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/384,336

(22) Filed: Mar. 7, 2003

(65) Prior Publication Data

US 2004/0175980 A1 Sep. 9, 2004

(51) Int. Cl.[7] ..... H01R 13/62
(52) U.S. Cl. ..... 439/327
(58) Field of Search ..... 439/326–329, 439/357–358

(56) References Cited

U.S. PATENT DOCUMENTS 4,986,765 A 1/1991 Korsunsky et al. ..... 439/326
6,250,938 B1 6/2001 Tung ..... 439/160
6,406,320 B1 6/2002 Wu ..... 439/358
6,540,540 B1 * 4/2003 Tobey ..... 439/327

* cited by examiner

*Primary Examiner*—Javaid H. Nasri
(74) *Attorney, Agent, or Firm*—Robert J. Zeitler

(57) ABSTRACT

A connector is provided for mounting a module, such as a voltage regulator module, to a printed circuit board. The connector includes a housing having side walls defining a slot for receiving a module, such as a voltage regulator module, therein. Terminals are provided in the housing and are in communication with the slot. Latches and solder nails are provided at opposite ends of the side walls. The solder nails and latches may be formed as two separate components which are connected together or may be integrally formed. When a force, such as from vibration and/or shock, is applied to the latches, the force is transmitted directly to the solder nail and directed away from the leads.

17 Claims, 5 Drawing Sheets

CONNECTOR WITH FORCE ISOLATING EJECTOR SYSTEM

FIELD OF THE INVENTION

This invention is directed to a novel way of mounting ejectors for a card type connector, and more specifically, to a connector for mounting a module, such as a voltage regulator module, to a printed circuit board. The connector includes an ejector and a mounting platform for the ejectors, such as a solder nail, which minimizes the stresses placed upon the connector terminal leads when forces, and in particular, vertical forces are applied to the connector.

BACKGROUND OF THE INVENTION

Prior art connectors which are used to mount a module to a printed circuit board include a housing and latches connected to opposite ends thereof. The latches are used to hold the module to the housing and can be used to eject the module from the housing. Solder nails are provided and are separate from the latches. The connector includes a plurality of terminals therein which have leads soldered to traces on the printed circuit board. During shock and/or vibration, the weight of the module subjects a vertical load on the latches which are held by the housing. This load is transferred directly to the housing and in turn to the all of the leads and the solder nails. The vertical load applies stress on the soldered joints of the leads can result in fracture of these joints.

OBJECTS AND SUMMARY OF THE INVENTION

A general object of the present invention is to provide a connector which minimizes the stress on leads of the connector connected to a printed circuit board when the connector is subject to shock and/or vibration.

An object of the present invention is to provide a connector which minimizes the stress on the leads of the connector connected to a printed circuit board during side-to-side movement of a module mounted to the connector.

Briefly, and in accordance with the foregoing, a connector is provided for mounting a module, such as a voltage regulator module, to a printed circuit board. The connector includes a housing having side walls defining a slot for receiving a module, such as a voltage regulator module, therein. Terminals are provided in the housing and are in communication with the slot. Ejectors and mounting platforms for receiving the ejectors are provided at opposite ends of the side walls. The ejectors also act to retain the module within the connector. The ejector and mounting platform may be formed as two separate components which are connected together or may be integrally formed. The ejector and the mounting platforms are such that they isolate the force that the ejector is subject to. For example, when a force, such as from vibration and/or shock, is applied to the ejectors, such as from a module mounted to the connector, the force is transmitted directly to the mounting platform and directed away from the connector terminal leads.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT(S)

Figures 1, 2:
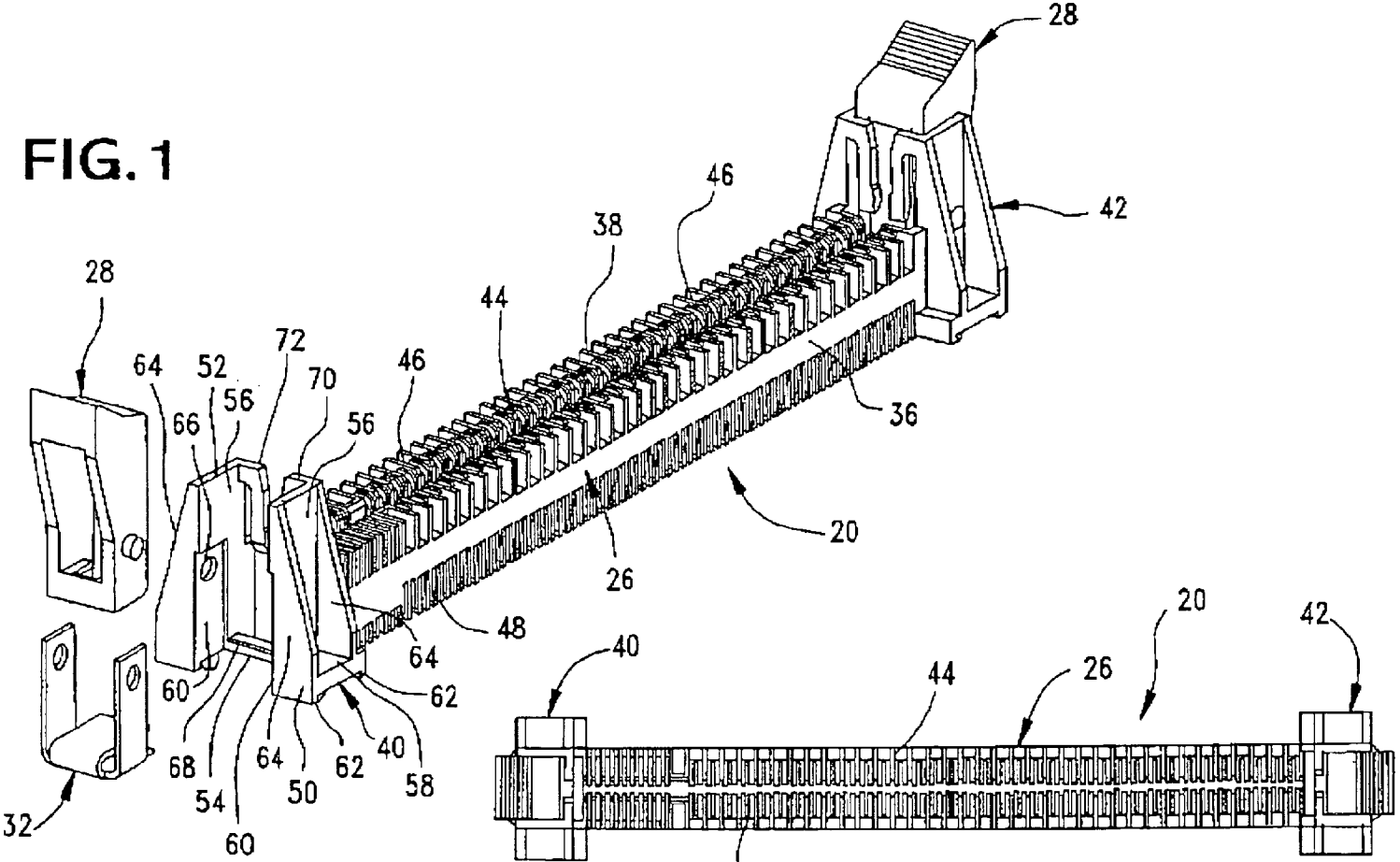
FIG. 1 is an exploded perspective view of a connector which incorporates the features of a first embodiment of the invention.
FIG. 2 is a top elevational view of the connector of FIG. 1.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

A low profile circuit board connector 20 for connecting a module 22 to a printed circuit board 24 is provided. The module 22 may be, for example, a voltage regulator module, a memory module, interface card, or some other type of auxiliary card or daughter circuit card. The connector 20 includes a housing 26 which has a pair of ejectors, or latches, and a pair of mounting platforms, or solder nails, associated therewith. The latches provide means for holding the module 22 with the housing 26 and provide a means for ejecting the module 22 from the housing 26. When a force from vibration and/or shock is applied to the latches, the force is transmitted mainly to the solder nails, with little or none of the force being transmitted to the housing 26.

Figure 8:
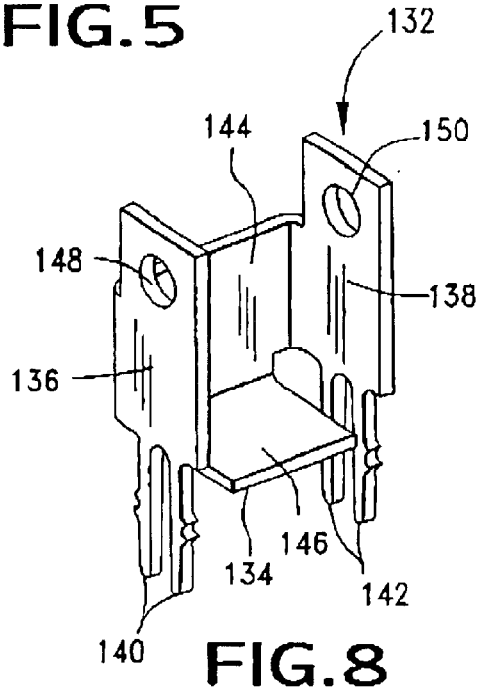
FIG. 8 is a perspective view of a solder nail which incorporates the features of a second embodiment of the invention.
Figure 11:
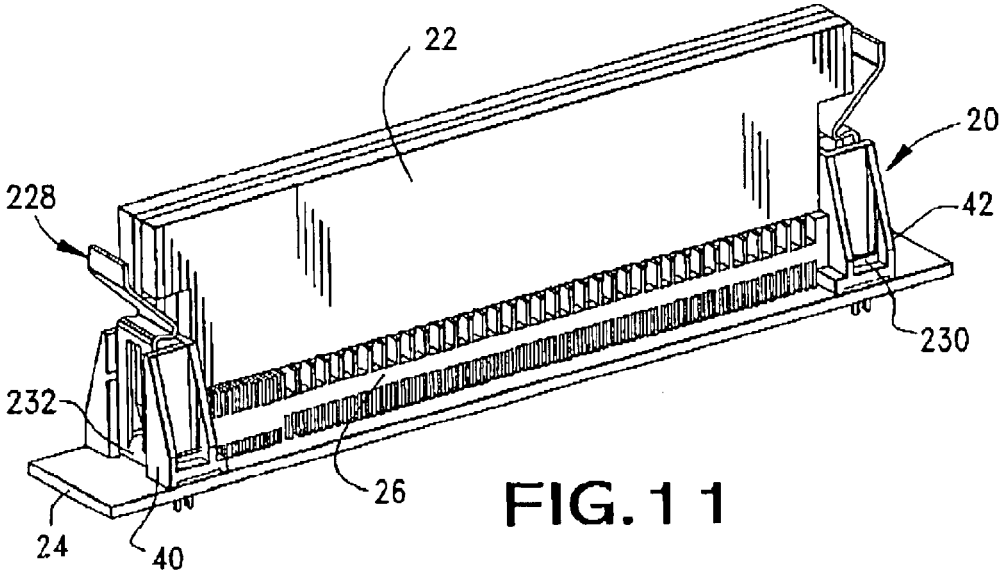
FIG. 11 is a perspective view of a connector which incorporates the features of a third embodiment of the invention.
Figure 12:
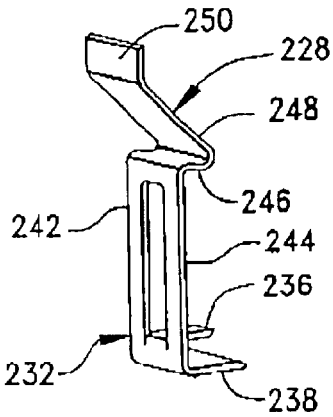
FIG. 12 is a perspective view of a solder nail used in the third embodiment of the connector.
Figure 13:
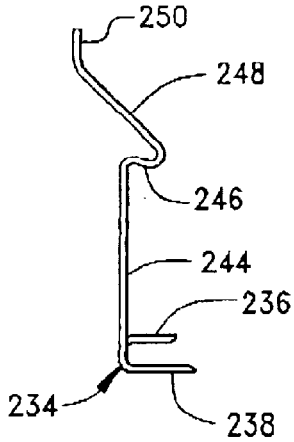
FIG. 13 is a side elevational view of the solder nail of FIG. 12.
Figure 14:
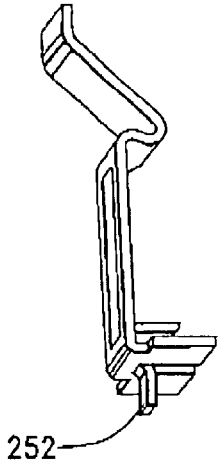
FIG. 14 is a perspective view of a modification of the solder nail of FIG. 11.

A first embodiment of the latch 28 and solder nail 32 (only one of which is shown) is shown in FIGS. 1–7 in which the latches 28 and the solder nails 32 are formed as two separate components. FIGS. 8–10 illustrates a second embodiment of the solder nail 132. A third embodiment of the latches 228 and the solder nails 232 is shown in FIGS. 11–13 in which the latches 228 and solder nails 232 are integrally formed. FIG. 14 illustrates a modification to the integrally formed latch 228 and solder nail 232 combination shown in FIG. 13.

The housing 26 used with each embodiment of the invention is identical. The housing 26 is formed of an insulative material and includes a pair of vertical side walls 36, 38 having opposite ends and an end wall 40, 42 provided at each end of the side walls 36, 38. An elongated slot 44 is formed within the side walls 36, 38 and the ends walls 40, 42 to receive an edge of the module 22.

A plurality of conductive terminals 46 are mounted within the housing 26 and a portion of each terminal 46 is located in the slot 44 for contacting the edge of an inserted module 22. The terminals 46 have tail ends or leads 48 which project downwardly from the housing 26 for mounting to the printed circuit board 24, either by surface mounting the tails to the printed circuit board, or by through hole mounting the tails into apertures, or vias, in the printed circuit board.

The end walls 40, 42 are identical and therefore only one of the end walls 40 is described with the understanding that the other end wall 42 is the mirror image of the described end wall 40. The end wall 40 includes a first side section 50, a second side section 52 and a middle section 54, a portion of which connects the first side section 50 to the second side section 52.

The first side section 50 includes an L-shaped base wall which has a vertical portion 56 and a horizontal portion 58. The vertical portion 56 has a rectangular recess 60 on its inner surface and the recess 60 extends from the bottom of the vertical portion 56 upwardly a predetermined distance. The recess 60 extends from the outer edge of the vertical portion 56 toward the side walls 36, 38. An aperture (not shown) is provided through the vertical portion 56 at the top end of the recess 60. A pair of spaced apart legs 62 depend from the horizontal portion 58. One or more locating pegs (not shown) can depend from the horizontal portion 58 to aid in properly positioning the housing 26 on the printed circuit board 24. A rib 64 is provided at each end of the L-shaped base wall and tapers from the upper end of the vertical portion 56 outwardly to the outer end of the horizontal portion 58. The second side section 52 is the mirror image of the first side section and like elements are denoted with the same reference numerals. The aperture 66 in the recess 60 is shown in the second side section 52.

The middle section 54 includes a horizontal bar 68 which extends between the horizontal portions 58 of the first and second side sections 50, 52 to space first and second side sections 50, 52 apart from each other. A pair of guide walls 70, 72 are provided proximate the top of the vertical portions 56 and are perpendicular thereto. The guide walls 70, 72 define a tapered passageway into which the module 22 is inserted.

Attention is now invited to the first embodiment of the latch 28 and the solder nail 32 shown in FIGS. 1–7. A latch 28 and a solder nail 32 are associated with each end wall 40, 42. The latches 28 provide means for holding the module 26 to the housing 22 and for ejecting the module 26 from the housing 22.

Figure 3:
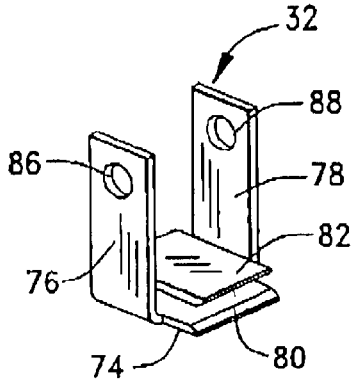
FIG. 3 is a perspective view of a solder nail which is a component of the connector of FIG. 1.
Figure 4:
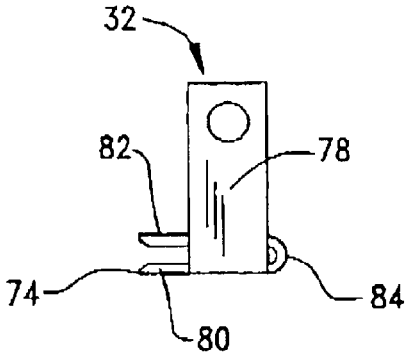
FIG. 4 is a side elevational view of the solder nail shown in FIG. 3.
Figure 5:
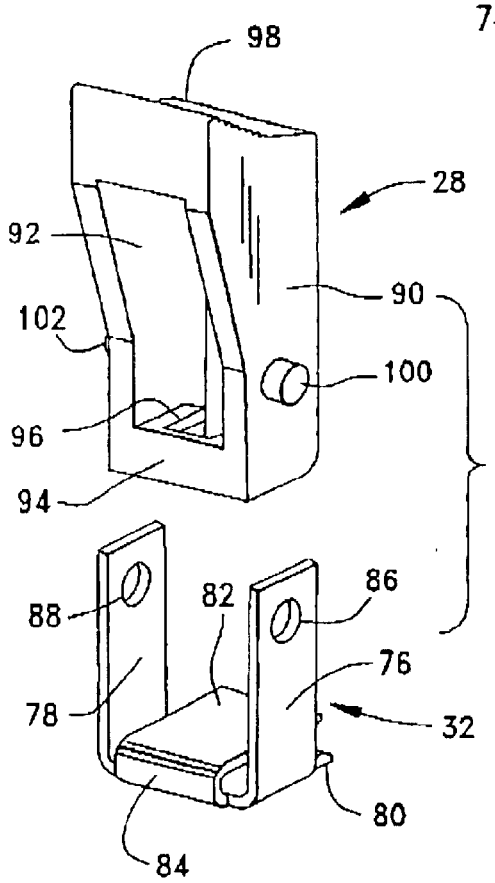
FIG. 5 is an exploded perspective view of the solder nail and a latch which is another component of the connector of FIG. 1.

Each solder nail 32 is identical and therefore only one of the solder nails 32 is described. The solder nail 32 is best illustrated in FIGS. 3–5. The solder nail 32 is preferably formed of metal and includes a generally U-shaped section 74 and a pair of arms 76, 78 extending therefrom. The U-shaped section 74 has a pair of spaced apart legs 80, 82 connected by a curved portion 84. The U-shaped section 74 is oriented such that the legs 80, 82 are horizontally mounted. The lower leg 80 has a large surface area. The surface area may be equal to one hundred percent of the surface area of the leads 48 or may have a smaller surface area. It is preferred that the surface area of the lower leg 80 is made as large as possible. The arms 76, 78 extend generally perpendicularly from the lower leg 80. An aperture 86, 88 is provided within each arm 76, 78, preferably proximate to a top thereof.

The latches 28 may take many forms and the ones illustrated in the drawings is illustrative of the shape of the latches 28. The specifics of the latches 28 is best illustrated in FIG. 5. The latch 28 includes a pair of vertical side walls 90, 92 which are spaced apart from each other. An end wall 94 and a bottom wall 96 respectively connect the outer and bottom edges of the side walls 90, 92 together. A top wall 98 connects the top edges of the side walls 90, 92 together. The top wall 98 has a slanted surface so that a user's digit may engage same so that the module 22 can be ejected from the housing 26. A protrusion 100, 102 is provided on the side walls 90, 92, preferably at positions which are below approximately the midpoint of the respective side wall 90, 92.

Assembly of one of the latches 28 and the solder nails 32 with respect to the housing 26 is described with the understanding that the other latch 28 and solder nail are assembled in the same manner. The latch 28 is inserted between the arms 76, 78 of the solder nail 32 and the protrusions 100, 102 are respectively inserted into the apertures 86, 88 in the arms 76, 78. The solder nail 32 is then inserted into the recesses 60 within the first and second side sections 50, 52 and the latch 32 sits between the vertical portions 56 of the first and second side sections 50, 52. The protrusions 100, 102 are respectively inserted into the apertures 66 through the vertical portions 56 of the first and second side sections 50, 52. The apertures 86, 88 in the solder nail 32 are smaller than the apertures 66 in the housing 26, and the protrusions 100, 102 have a diameter that is smaller than the apertures 66 in the housing 26. One of the primary reasons for there being apertures 66 in the housing is that the protrusions 100, 102 need to be robust enough to be able to withstand the shock and vibration forces being transmitted into the latches 28, thereby necessitating that the protrusions be longer that the thickness of the arms 76, 78. Thus, although the protrusions 100, 102 may be received within the apertures 66, the fit between the protrusions 100, 102 and the apertures 66 is not required to be a tight fit, but rather, play can be tolerated, and in fact is preferred, between the sidewalls of the apertures 66 and the outer surfaces of the protrusions 100, 102. By having this play, force transmitted to the latches 28 will then be transmitted into the solder nails 32, and not into the connector housing 26. As a result of this force transmission path, the leads 48 of the terminals 46 are less likely to be damaged by force transmitted into the latches 28. The same process is used to assemble the other latch 28 and solder nail in relation to the end wall 42 to complete the connector 20. The latches 28 can pivot via the protrusions 100, 102 relative to the respective solder nails 32 to allow for entry or ejection of the module 22.

To assemble the connector 20 to the printed circuit board 24, the connector 20 is placed onto the printed circuit board 24 such that the lower legs 80 of the solder nails 32 and the leads 48 abut the printed circuit board 24. The lower legs 80 of the solder nails 32 and the leads 48 are soldered, such as by infrared soldering, to the printed circuit board 24 to surface mounts the leads 48 to the printed circuit board 24.

When the connector 20 is subjected to shock and/or vibration, a vertical load is placed on the latches 28. Each latch 28 places an upward force on the respective solder nail 32 through the engagement of the protrusions 100, 102 with the arms 76, 78 of the solder nail 32 and transfers the load to the solder nail 32. The load is not transferred to the housing 26 because the apertures 66 through the housing 26 are larger than the apertures 86, 88 through the solder nails 32 such that when the load is placed on the latches 28, the latches 28 do not transmit the load into the housing 26. The solder nails 32 have large surface areas, via lower leg 80, in contact with the printed circuit board 24 and transmits the forces to the printed circuit 24 over a large area. While some force may be applied to the housing 26 when the connector 20 is subjected to shock and/or vibration, the majority of the force is transmitted to the solder nails 32 through the latches 28. Therefore, the stresses on the joints between the leads 48 and the printed circuit board 24 are minimized, thereby minimizing the possibility of damage to the solder joints between the leads and the printed circuit board.

In addition, because of the aims 76, 78 of the solder nails 32 that extends upwardly, if the module 22 is moved from side-to-side once mounted, the arms 76, 78 provide rigidity to deter transferring loads to the housing 26 and thus to the joints between the leads 48 and the printed circuit board 24.

Figures 6, 9:
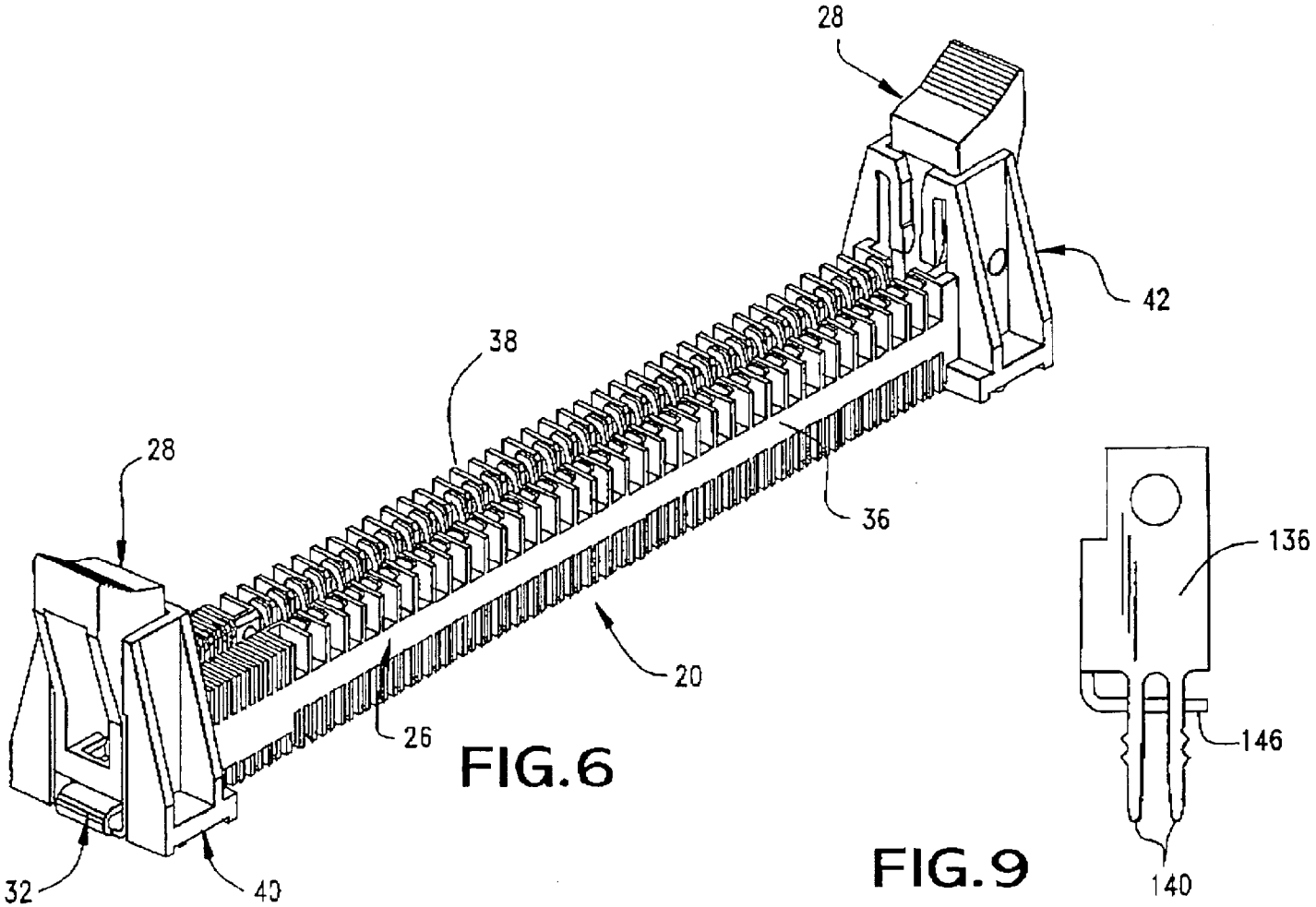
FIG. 6 is an assembled perspective view of the connector of FIG. 1.
FIG. 9 is a side elevational view of the solder nail of FIG. 8.
Figures 7, 10:
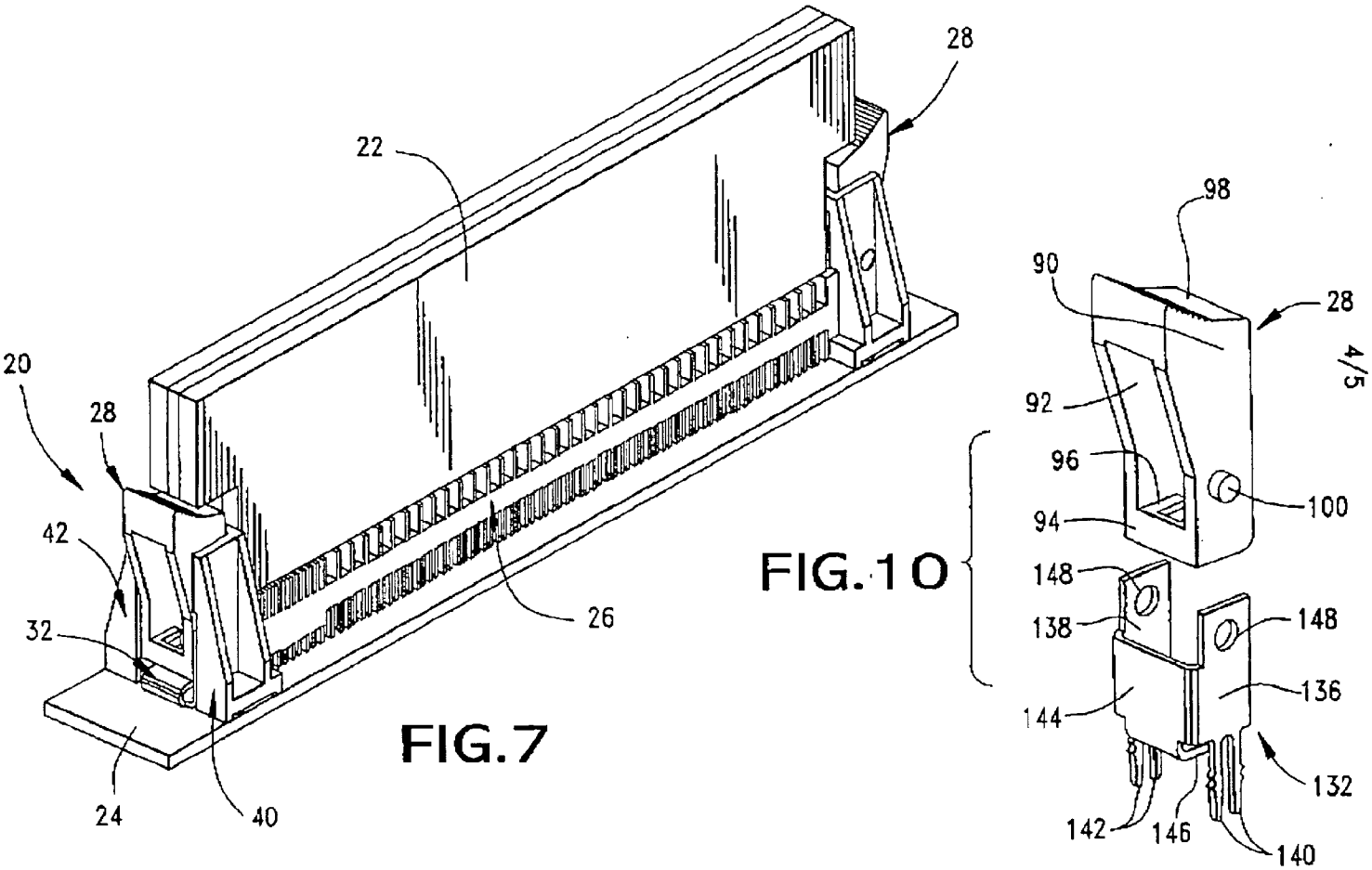
FIG. 7 is an assembled perspective view of the connector of FIG. 1 shown attached to a printed circuit board and a module.
FIG. 10 is an exploded perspective view of the solder nail shown in FIGS. 8 and 9 and the latch.

Attention is now invited to the second embodiment shown in FIGS. 8–10. In this second embodiment, only the solder nails 132 have been modified. Therefore, the other components of the connector 20 are not described.

Each solder nail 132 is identical and therefore only one of the solder nails 132 is described. The solder nail 132 is formed of metal and includes a generally L-shaped section 134, a pair of arms 136, 138 extending therefrom, and a pair of board locks 140, 142 depending from each arm 136, 138. The generally L-shaped section 134 has a vertical leg 144 and a lower horizontal leg 146 which are generally perpendicular to each other. The lower horizontal leg 146 has a large surface area. The surface area may be equal to one hundred percent of the surface area of the leads 48 or may have a smaller surface area. It is preferred that the surface area of the lower leg 146 is made as large as possible. The aims 136, 138 extend generally perpendicularly to the lower leg 146 and are connected to the vertical leg 144. An aperture 148, 150 is provided within each arm 136, 138 proximate to a top thereof. The board locks 140, 142 extend downwardly from the lower end of the aims 136, 138.

Assembly of one of the latches 28 and the solder nails 132 relative to the housing 26 is described with the understanding that the other latch and solder nail are assembled in the same manner. The latch 28 is inserted between the arms 136, 138 of the solder nail 132 and the protrusions 100, 102 are respectively inserted into the apertures 148, 150 in the aims 136, 138. The solder nail 132 are then inserted into the recesses 60 within the first and second side sections 50, 52 and the latch 32 sits between the vertical portions 56 of the first and second side sections 50, 52. The protrusions 100, 102 are respectively inserted into the apertures 66 through the vertical portions 56 of the first and second side sections 50, 52. The apertures 148, 150 in the solder nail 132 are smaller than the apertures 66 in the housing 26, and the protrusions 100, 102 have a diameter that is smaller than the apertures 66 for the same reasons as described relating to the solder nail 32. The same process is used to assemble the other latch 28 and solder nail in relation to the end wall 42 to complete the connector 20. The latches 28 can pivot via the protrusions 100, 102 relative to the respective solder nails 132 to allow for entry or ejection of the module 22. Because the protrusions 100, 102 do not bear against the housing 26, the latches 26 and the solder nails 132 minimize, if not eliminate, the transmission of force from the latches into the housing 26.

To assemble the connector 20 to the printed circuit board 24, the board locks 140, 142 and the leads 48 are mounted through holes provided in the printed circuit board 24. The horizontal legs 146 of the solder nails 132 abut against the printed circuit board 24. If wave soldering is used, the board locks 140, 142 and the leads 48 are soldered to the printed circuit board 24; the lower legs 146 of the solder nails 132 abut against the printed circuit board 24, but are not necessarily soldered to the printed circuit board 24. Alternatively, the board locks 140, 142, the leads 48 and the lower horizontal legs 146 of the solder nails 132 can be soldered to the printed circuit board 24 by infrared soldering and the leads 48 can be surface mounted to the printed circuit board 24.

When the connector 20 is subjected to shock and/or vibration, a vertical load is placed on the latches 28. Each latch 28 places an upward force on the respective solder nail 132 through the engagement of the protrusions 100, 102 with the arms 136, 138 of the solder nail 132 and transfers the load to the solder nail 132. The load is not transferred to the housing 26 because the apertures 66 through the housing 26 are larger than the apertures 148, 150 through the solder nails 132 such that when the load is placed on the latches 28, the latches 28 do not transmit the load into the housing 26. The solder nails 132 have large surface areas, via lower leg 146, in contact with the printed circuit board 24 and transmits the forces to the printed circuit 24 over a large area. While some force may be applied to the housing 26 when the connector 20 is subjected to shock and/or vibration, the majority of the force is transmitted to the solder nails 132 through the latches 28. Therefore, the stresses on the joints between the leads 48 and the printed circuit board 24 are minimized, thereby minimizing the possibility of damage to the solder joints between the leads and the printed circuit board.

In addition, because of the arms 136, 138 of the solder nails 132 that extends upwardly, if the module 22 is moved from side-to-side once mounted, the arms 136, 138 provide rigidity to deter transferring loads to the housing 26 and thus to the joints between the leads 48 and the printed circuit board 24.

Attention is now invited to the third embodiment of the connector shown in FIGS. 11–13. The latch 228 and solder nail 232 are integrally formed as one member formed of metal in the third embodiment. The integrally formed latch 228 and solder nail 232 is provided at each end of the housing 26, and are identical. Therefore, only a single integrally formed latch 228 and solder nail 232 is described with the understanding that the other integrally formed latch and solder nail is identical.

The portion which forms the solder nail 232 includes a generally U-shaped lower portion 234 formed of an upper horizontal leg 236 and a lower horizontal leg 238 connected together by a base 240. The lower leg 236 has a large surface area. The surface area may be equal to one hundred percent of the surface area of the leads 48 or may have a smaller surface area. It is preferred that the surface area of the lower leg 236 is made as large as possible. A flexible pair of arms 242, 244 extend upwardly from the base 240 and are connected to the latch 228. The flexible arms 242, 244 are generally perpendicular to the legs 236, 238 in the unflexed condition. The portion that forms the latch 228 includes a first portion 246 which extends inwardly and downwardly from the tops of the arms 242, 244, a second portion 248 which extends outwardly and upwardly from the end of the first portion 246, and a third portion 250 which extends upwardly from the end of the second portion 250. The latch 228 can be flexed outwardly when the module 22 is inserted into the connector 20 such that the latch 228 effectively pivots relative to the housing 26, and a user can grip the third portion 250 to flex the arms 242, 244 away from the module 22 such that the latch 228 is disengaged from the module 22 for removal of the module 22.

The assembly of the combination latch 228 and solder nail 232 with the housing 26 and the printed circuit board 24 is now described. The housing 26 is placed against the printed circuit board 24. Each combination latch 228 and solder nail 232 is inserted between the vertical portions 56 of the respective end walls 40, 42. Each combination latch 228 and solder nail 232 is not connected to the end walls 40, 42. The combination latch 228 and solder nail 232 can flex relative to the housing 26. The lower horizontal leg 238 of the solder nail 232 and the leads 48 are soldered, such as by infrared soldering, to the printed circuit board 24 to surface mount the leads 48 to the printed circuit board 24.

When the connector 20 is subjected to shock and/or vibration, a vertical load is placed on each combination latch 228 and solder nail 232. The force on each latch 28 is transmitted to the solder nail 232 since the latch 228 and the solder nail 232 are integrally formed. The solder nails 232 have large surface areas, via lower leg 238, in contact with the printed circuit board 24 and transmits the forces to the printed circuit 24 over a large area. While some force will be applied to the housing 26 when the connector 20 is subjected to shock and/or vibration, the majority of the force is transmitted to the solder nails 232 through the latches 228. Therefore, the stresses on the joints between the leads 48 and the printed circuit board 24 are minimized, thereby minimizing the possibility of damage to the solder joints between the leads and the printed circuit board. The vertical portions 56 of the housing 26 provide rigidity if the module 22 is moved from side-to-side once mounted.

Alternatively, the portion that forms the solder nail 232 can be modified to include a solder post 252 which extends downwardly from the lower horizontal leg 238 as shown in FIG. 14. The solder post 252 provides additional means for connecting the combination latch 228 and solder nail 232 to the printed circuit board 24 and provides means for properly aligning the combination latch 228 and solder nail 232 with the printed circuit board 24 .

While the terms vertical, horizontal, upper, lower, bottom, top and the like are used herein, it is to be understood that these terms are used for ease in describing the invention and does not denote a required orientation when mounted to the printed circuit board 24 and the module 22.

While preferred embodiments of the present invention are shown and described, it is envisioned that those skilled in the art may devise various modifications of the present invention without departing from the spirit and scope of the appended claims.

What is claimed is:

1. A connector for connecting a module to a printed circuit board, the connector comprising:

a housing having vertical side walls defining a slot for receiving a module therein;

terminals mounted in the housing and in communication with the slot;

mounting platforms provided at opposite ends of the vertical side walls, the mounting platforms not being integral with the housing, each mounting platform including a horizontal section which is perpendicular to the vertical side walls of the housing and a vertical section which is perpendicular to the horizontal section, the horizontal section being capable of being seated against a printed circuit board; and latches directly connected to the vertical sections of the respective mounting platforms, the latches capable of releasably holding the module, wherein when forces are applied to the latches by insertion of the module, the forces are transmitted from the vertical sections of the mounting platforms to the horizontal sections of the mounting platforms.

2. The connector defined in claim 1, wherein the mounting platform has a surface area, each terminal has a surface area that is mounted to a surface of a printed circuit board, and wherein the surface area of the mounting platform is approximately the same as the total of the terminal surface area.

3. The connector defined in claim 1, further including board locks extending from the mounting platforms.

4. The connector defined in claim 1, wherein the horizontal section of each mounting platform is soldered to a printed circuit board.

5. The connector defined in claim 1, wherein the terminals are capable of being surface mounted to a printed circuit board.

6. The connector defined in claim 1, wherein the terminals are capable of being through-hole mounted to a printed circuit board.

7. The connector defined in claim 1, wherein each latch and the mounting platform are integrally formed.

8. The connector defined in claim 7, wherein the mounting platform includes a post extending therethrough which is capable of being connected to a printed circuit board.

9. The connector defined in claim 7, wherein each mounting platform includes a flexible portion which is attached to the respective latch.

10. The connector defined in claim 1, wherein each latch and the mounting platform are formed as two separate physical components.

11. A connector for connecting a module to a printed circuit board, the connector comprising;

a housing having side walls defining a slot for receiving a module therein;

terminals mounted in the housing and in communication with the slot;

mounting platforms provided at opposite ends of the side walls, the mounting platforms not being integral with the housing; and latches directly connected to the respective mounting platforms, the latches being capable of releasably holding the module, wherein the side walls have opposite ends and the housing includes end portions at the opposite ends of the side walls and apertures provided through the ends portions; wherein each latch includes protrusions extending therefrom, and each mounting platform has apertures provided therethrough, the protrusions extending through the respective apertures in the respective mounting platforms and the respective apertures in the respective end portions.

12. The connector defined in claim 11, wherein the apertures in the mounting platforms are smaller than the apertures provided in the end portions.

13. A connector for connecting a module to a printed circuit board, the connector comprising:

a housing having side walls defining a slot for receiving a module therein;

terminals mounted in the housing and in communication with the slot;

mounting platforms provided at opposite ends of the side walls, the mounting platforms not being integral with the housing; and latches directly connected to the respective mounting platforms, the latches being capable of releasably holding the module, wherein each latch includes protrusions extending therefrom, and each mounting platform has apertures provided therethrough, the protrusions extending through the respective apertures in the respective mounting platforms.

14. A combination comprising:

a printed circuit board;

a module;

a connector for connecting the printed circuit board to the module, the connector including a housing having vertical side walls defining a slot for receiving the module therein, terminals mounted in the housing and in communication with the slot, solder nails provided at opposite ends of the vertical side walls, the solder nails not being integral with the housing, each solder nail including a horizontal section which is perpendicular to the side walls of the housing and a vertical section which is perpendicular to the horizontal section, the horizontal section abutting against the printed circuit board, and latches directly connected to the vertical sections of the respective solder nails, the latches releasably holding the module therein, wherein when forces are applied to the latches by insertion of the module, the forces are transmitted from the vertical sections of the solder nails to the horizontal sections of the solder nails.

15. The combination defined in claim 14, wherein the terminals are through-hole mounted to the printed circuit board.

16. The combination defined in claim 14, wherein the terminals are surface mounted to the printed circuit board.

17. The combination defined in claim 14, wherein the horizontal section of each solder nail is soldered to the printed circuit board.

* * * * *